US006891520B2

(12) United States Patent
Chen et al.

(10) Patent No.: US 6,891,520 B2
(45) Date of Patent: May 10, 2005

(54) ACTIVE MATRIX LED PIXEL DRIVING CIRCUIT

(75) Inventors: Shang-Li Chen, Hsinchu (TW); Chien-Ru Chen, Pingtung (TW); Jun-Ren Shih, Changhua (TW)

(73) Assignee: Industrial Technology Research Institute, Hsinchu (TW)

( * ) Notice: Subject to any disclaimer, the term of this patent is extended or adjusted under 35 U.S.C. 154(b) by 288 days.

(21) Appl. No.: 10/232,705

(22) Filed: Sep. 3, 2002

(65) Prior Publication Data

US 2003/0098829 A1 May 29, 2003

(30) Foreign Application Priority Data

Nov. 28, 2001 (TW) ..... 90129367 A

(51) Int. Cl.[7] ..... G09G 3/32
(52) U.S. Cl. ..... 345/82; 345/83
(58) Field of Search ..... 345/76–80, 82, 345/83, 46, 45, 55, 205, 206; 315/169.1–169.4

(56) References Cited

U.S. PATENT DOCUMENTS 4,445,132 A * 4/1984 Ichikawa et al. ..... 257/72
5,952,789 A * 9/1999 Stewart et al. ..... 315/169.4
6,023,259 A * 2/2000 Howard et al. ..... 345/76
6,307,528 B1 * 10/2001 Yap ..... 345/45
6,348,906 B1 * 2/2002 Dawson et al. ..... 345/82
6,373,454 B1 * 4/2002 Knapp et al. ..... 345/76
2002/0030647 A1 * 3/2002 Hack et al. ..... 345/82
2003/0095087 A1 * 5/2003 Libsch et al. ..... 345/82
2004/0080474 A1 * 4/2004 Kimura ..... 345/82

* cited by examiner

*Primary Examiner*—Vijay Shankar
*Assistant Examiner*—Prabodh M Dharia
(74) *Attorney, Agent, or Firm*—Birch, Stewart, Kolasch & Birch, LLP

(57) ABSTRACT

A circuit for driving active matrix LED pixels, having a capacitor, a light emitting diode, and a first and second transistor. The capacitor is connected between a gate and source of the first transistor, and the second transistor has a source connected to a drain of the first transistor and a gate connected to receive a first voltage by which the first and second transistor operates in a saturation region, and a current switch controlled by a scan signal, wherein a first current corresponding to a data signal flows through the first and second transistor to generate a second voltage stored on the capacitor when the current switch is closed, and a second current through the first and second transistor is generated by the second voltage stored on the capacitor to turn on the light emitting diode when the current switch is opened.

4 Claims, 8 Drawing Sheets

ACTIVE MATRIX LED PIXEL DRIVING CIRCUIT

BACKGROUND OF THE INVENTION

1. Field of the Invention

The present invention relates to an active matrix LED pixel driving circuit and particularly to an active matrix OLED/PLED pixel driving circuit.

2. Description of the Prior Art

Organic light emitting diodes (OLEDs) or polymer light emitting diodes (PLEDs) are more and more popularly used in flat displays due to their high speed performance, low power consumption and low cost. The OLED/PLED displays also have a wider angle of view than that of conventional liquid crystal displays using backlight systems since the OLEDs or PLEDs emit light themselves.

There are two categories of LED display, passive and active matrix. In the passive matrix display, each LED is provided with a driving current for only one scan period in one frame and is turned off until beginning of the scan period in the next frame. Each LED emits light strong enough in each short scan period to achieve a satisfied overall illumination level of the display. Thus, a large driving current is necessary. However, the large driving current shortens the lifetime of the LEDs as well as inducing a large power consumption.

On the contrary, the active matrix LED display does not have the previous drawbacks. It uses capacitors charged by the driving current during the scan period and keeping voltages thereon until the scan period of the next frame. These voltages allow currents driving LEDs to be turned on after the end of the scan period. Thus, the LEDs are turned on for a longer time period and the driving current can be lower than that of the passive matrix display.

The LEDs in the display can be driven by voltages or currents. FIG. 1 is a diagram showing one voltage-driven pixel circuit in an active matrix LED display. It comprises transistors 11 and 12, a capacitor 13, and an LED 14. The gate of the transistor 11 receives a scan signal SS through a scan line while its source receives a data signal DS through a data line. The data signal for this pixel is transmitted to the gate of the transistor 12 when the transistor 11 is turned on by the scan signal SS. If this pixel is lit in the current frame, the voltage level of the data signal DS turns on the transistor 12 to generate a driving current through the transistor 12 lighting the LED 14. In the meantime, the capacitor 13 is charged and keeps a voltage Vgs thereon. The voltage Vgs succeeds the data signal DS to keep the transistor 12 turned on when the scan signal SS turns off the transistor 11 to terminate transmission of the data signal DS at the end of the scan period. However, the pixel circuit in FIG. 1 suffers drift of the threshold voltage Vt which may result in drift of the driving current. The magnitude differences between the driving currents in the pixels lead to non-uniform illumination on the display panel.

FIG. 2 is a diagram showing one current-driven pixel circuit in an active matrix LED display. It comprises transistors 21, 22, 23 and 24, a capacitor 25, and an LED 26. The gate of the transistor 21 receives a scan signal SS through a scan line while its source receives a data signal DS through a data line. The gate of the transistor 22 also receives the scan signal SS. When the transistors 21 and 22 are turned on by the scan signal SS, the transistors 23 and 24 act as a current mirror so that the current through the transistor 23 is reproduced and flows through the transistor 24 to light the LED 26. In the meantime, the capacitor 25 is charged and keeps the voltage Vgs of the transistor 24 thereon. The voltage Vgs succeeds the data signal DS to keep the transistor 24 turned on when the scan signal SS turns off the transistors 21 and 22 to terminate transmission of the data signal DS at the end of the scan period.

FIG. 3A is a diagram showing another current-driven pixel circuit in an active matrix LED display. It comprises transistors 31, 32, 33 and 34, a capacitor 35, and an LED 36. The gate of the transistor 31 receives a scan signal SS through a scan line while its source receives a data signal DS through a data line. The gates of the transistors 32 and 33 also receive the scan signal SS. When the transistors 31 and 32 are turned on and the transistor 33 is turned off by the scan signal SS, the gate and drain of the transistor 34 are electrically connected, and the voltage Vgs is generated and has a magnitude corresponding to the current through the data line and the transistor 34. In the meantime, the capacitor 35 is charged and keeps the voltage Vgs thereon. The voltage Vgs succeeds the data signal DS to keep the current through the transistors 33 and 34 lighting the LED 36 when the scan signal SS turns off the transistors 31 and 32 and turns on the transistor 33 to terminate transmission of the data signal DS at the end of the scan period. FIG. 3B is a diagram showing a modified configuration of the circuit in FIG. 3A. They are similar in circuit operation. The PMOS transistor 34 is replaced by a NMOS transistor and the capacitor 35 exchanges with the transistor 32.

FIG. 4A is a diagram showing another current-driven pixel circuit in an active matrix LED display. It comprises transistors 41, 42, 43 and 44, a capacitor 45, and an LED 46. The gate of the transistor 41 receives a scan signal SS through a scan line while its source receives a data signal DS through a data line. The gate of the transistors 42 and 43 also receive the scan signal SS. When the transistors 41 and 42 are turned on and the transistor 43 is turned off by the scan signal SS, the gate and drain of the transistor 44 are electrically connected, and the voltage Vgs of the transistor 44 is generated and has a magnitude corresponding to the current through the data line, the transistors 41 and 44, and the OLED 46. The capacitor 45 is charged and keeps the voltage Vgs thereon. The voltage Vgs succeeds the data signal DS to light the OLED 46 by generating a current through the transistor 44 when the scan signal SS turns off the transistors 41 and 42 and turns on the transistor 43 to terminate transmission of the data signal DS at the end of the scan period. FIG. 4B is a diagram showing a modified configuration of the circuit in FIG. 4A. They are similar in circuit operation. The PMOS transistor 44 is replaced by a NMOS transistor and the capacitor 45 exchanges with the transistor 42.

FIG. 5 is a diagram showing an equivalent circuit of all the current-driven pixel circuits described previously. It comprises a transistor 51, a capacitor 52, a current switch 53 and an LED 54. The current switch 53 comprises three switches 531~533, and a data line connected to a current source (not shown). The switches 531~533 are controlled by the scan signal SS. The current source connected with the data line provides currents driving the LED 54.

At the beginning of the scan period, the switches 531 and 532 are closed and the switch 533 is opened. If this pixel is lit in the current frame, the current I of the data signal DS flows through the transistor 51 and charges the capacitor 52 to keep the voltage Vgs thereon. When the scan signal opens the switches 531 and 532 and closes the switch 533, the voltage Vgs succeeds the data signal DS to light the LED 54 by generating a current I' through the transistor 51.

The current-driven pixel circuits described previously still suffer disadvantages resulting from channel length modulation although the drift of the threshold voltage has no significant impact on the illumination uniformity. As shown in FIG. 6, curves $L2_1$, $L2_2$ and $L2_3$ indicate the I-V characteristics of three transistors with different threshold voltages during the scan period (with the gate and drain connected). The line L1 indicates the I-V characteristics of the current source connected to the data line for transmission of the data signal DS. The magnitudes of the drain-to-source current and gate-to-source voltage of the transistors in a steady state during the scan period can be derived from the intersections a1, b1 and c1 of the curves $L2_1$, $L2_2$ and $L2_3$, and the line L1. As shown in FIG. 6, curves $L3_1$, $L3_2$ and $L3_3$ indicate the I-V characteristics of the three transistors beyond the scan period (with the gate and drain isolated from each other). The curve L4 indicates the I-V characteristics of the LED. The magnitudes of the drain-to-source current and gate-to-source voltage of the transistors in a steady state beyond the scan period can be derived from the intersections a2, b2 and c2 of the curves $L3_1$, $L3_2$ and $L3_3$, and the line L4. It is noted that the channel length modulation results in non-overlapping of the curves $L3_1$, $L3_2$ and $L3_3$ so that the magnitudes of the drain-to-source current of the three transistors are the same during the scan period but shifted to different values beyond the scan period. Thus, the illumination on the display panel is non-uniform due to the channel length modulation even if the threshold voltages of the transistors are the same.

SUMMARY OF THE INVENTION

The object of the present invention is to provide an active matrix OLED/PLED pixel driving circuit which eliminates the unfavorable effects resulting from the channel length modulation.

The present invention provides an active matrix LED pixel driving circuit. The circuit comprises a capacitor, a light emitting diode, a first and second transistor, wherein the capacitor is connected between a gate and source of the first transistor, and the second transistor has a source connected to a drain of the first transistor and a gate connected to receive a first voltage by which the first and second transistor operates in a saturation region, and a current switch controlled by a scan signal, wherein a first current corresponding to a data signal flows through the first and second transistor to generate a second voltage stored on the capacitor when the current switch is closed, and a second current through the first and second transistor is generated by the second voltage stored on the capacitor to turn on the light emitting diode when the current switch is opened.

Thus, in the invention, a transistor is cascaded to the transistor through which the LED driving current flows. A gate bias voltage is applied to the two transistors so that they operate in the saturation region. The I-V characteristic curves of these saturated transistors are closer to each other than those of transistors operating in the linear region, which diminishes the current shift and enhances the illumination uniformity.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 7:
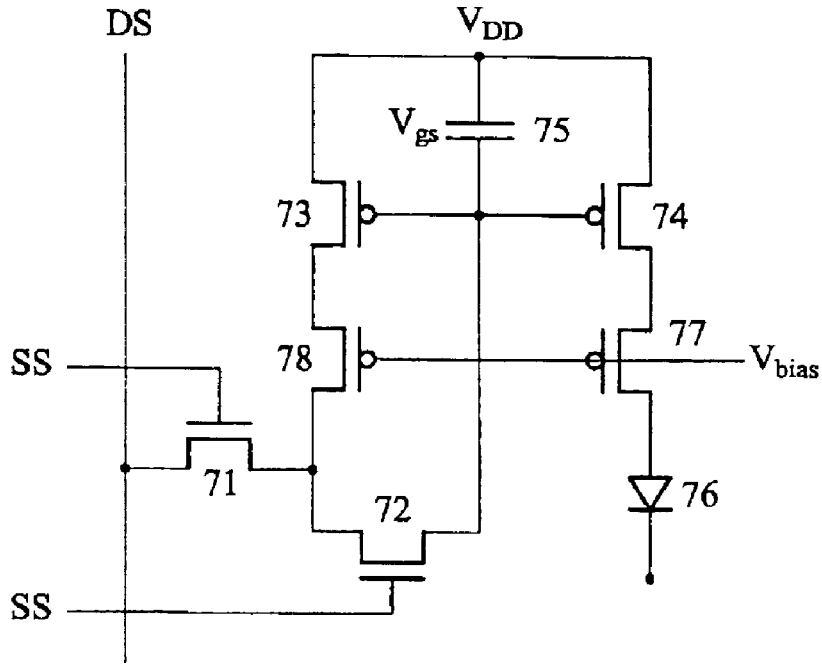
FIGS. 7, 7', 8 and 9 are diagrams showing current-driven pixel circuits in an active matrix LED display according to embodiments of the invention.
Figure 7:
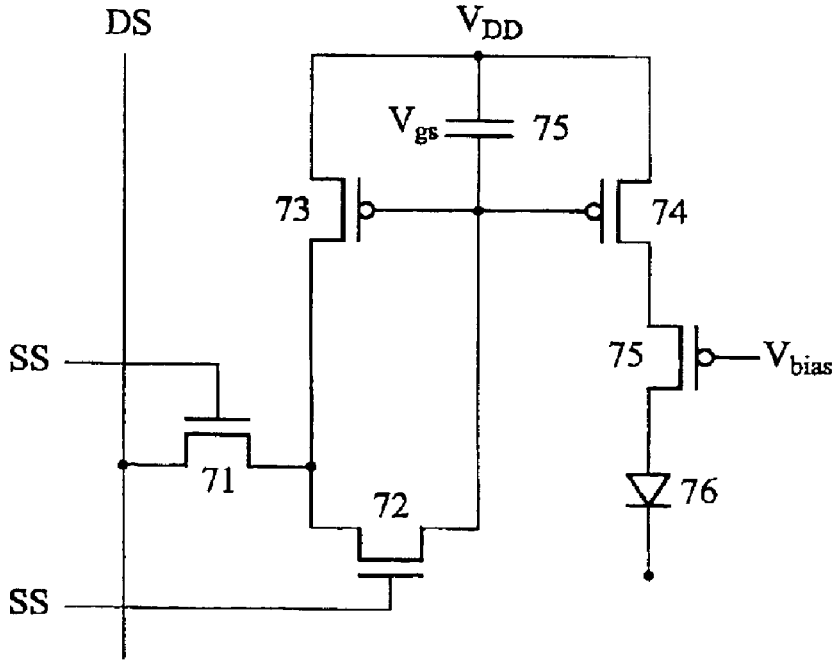

FIG. 7 is a diagram showing a current-driven pixel circuit in an active matrix LED display according to a first embodiment of the invention. It comprises transistors 71~74, 77, and 78, a capacitor 75, and an LED 76. The gate of the transistor 71 receives a scan signal SS through a scan line while its source receives a data signal DS through a data line. The gate of the transistor 72 also receives the scan signal SS. When the transistors 71 and 72 are turned on by the scan signal SS, the transistors 73 and 74 act as a current mirror so that the current through the transistor 73 is reproduced and flows through the transistor 74 to light the LED 76. In the meantime, the capacitor 75 is charged and keeps the voltage Vgs of the transistor 74 thereon. The voltage Vgs succeeds the data signal DS to keep the transistor 74 turned on when the scan signal SS turns off the transistors 71 and 72 to terminate transmission of the data signal DS at the end of the scan period. This circuit differs from the conventional circuit in that the transistors 77 and 78 are cascaded to the transistors 74 and 73 respectively. The gates of the transistors 77 and 78 receive a bias voltage $V_{bias}$ so that the transistors 73 and 74 operate in the saturation region.

Alternatively, the transistor 78 may be removed and this will not induce alternation of the circuit performance and operation, as shown in FIG. 7'.

Figure 8:
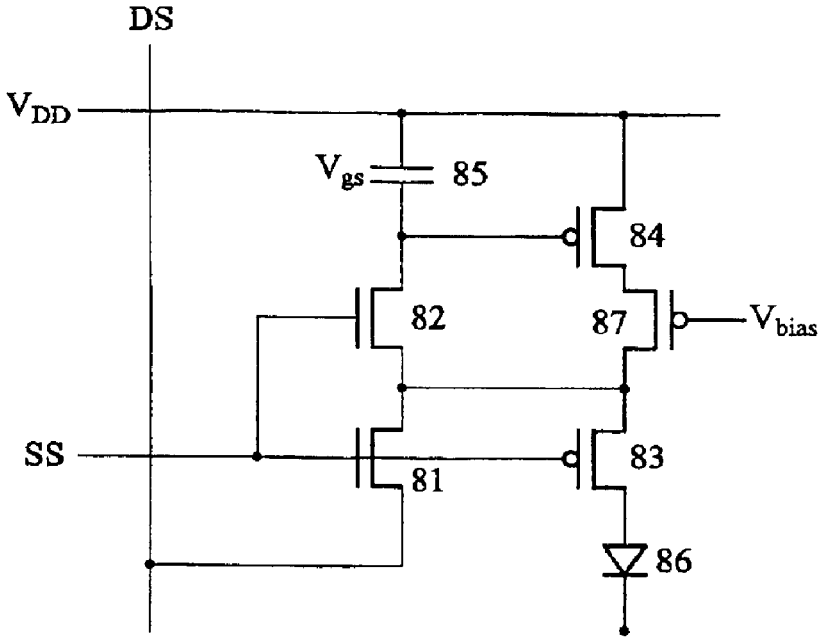

FIG. 8 is a diagram showing a current-driven pixel circuit in an active matrix LED display according to a second embodiment of the invention. It comprises transistors 81~84, and 87, a capacitor 85, and an LED 86. The gate of the transistor 81 receives a scan signal SS through a scan line while its source receives a data signal DS through a data line. The gates of the transistors 82 and 83 also receive the scan signal SS. When the transistors 81 and 82 are turned on and the transistor 83 is turned off by the scan signal SS, the voltage Vgs is generated and has a magnitude corresponding to the current through the data line and the transistor 84. In the meantime, the capacitor 85 is charged and keeps the voltage Vgs thereon. The voltage Vgs succeeds the data signal DS to keep the current through the transistors 83, 84 and 87 lighting the LED 86 when the scan signal SS turns off the transistors 81 and 82 and turns on the transistor 83 to terminate transmission of the data signal DS at the end of the scan period. This circuit differs from the conventional circuit in that the transistor 87 is connected to the drain of the transistor 84. The gate of the transistors 87 receives a bias voltage $V_{bias}$ so that the transistors 84 and 87 operate in the saturation region.

Figure 9:
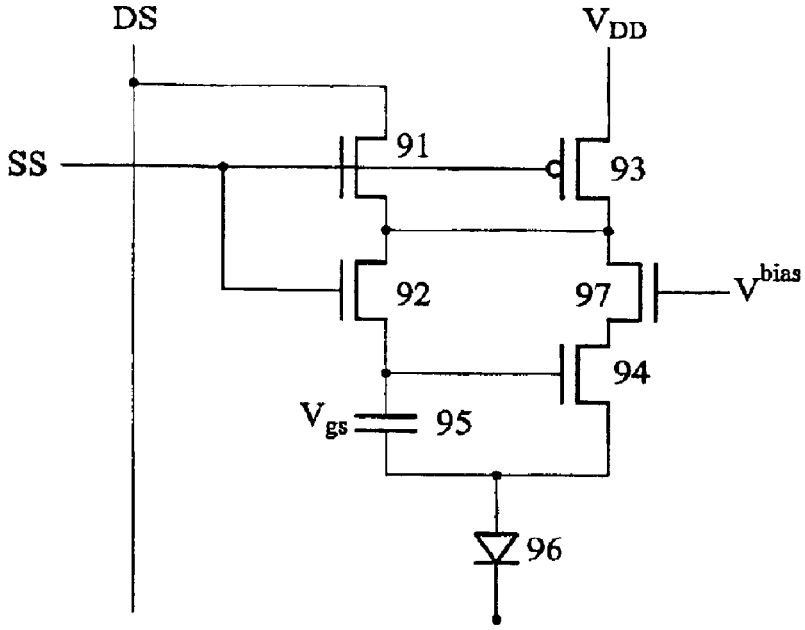

FIG. 9 is a diagram showing a current-driven pixel circuit in an active matrix LED display according to a third embodiment of the invention. It comprises transistors 91~94, and 97, a capacitor 95, and an LED 96. The gate of the transistor 91 receives a scan signal SS through a scan line while its source receives a data signal DS through a data line. The gate of the transistors 92 and 93 also receive the scan signal SS. When the transistors 91 and 92 are turned on and the transistor 93 is turned off by the scan signal SS, the voltage Vgs of the transistor 94 is generated and has a magnitude corresponding to the current through the data line, the transistors 91, 97 and 94, and the OLED 96. The capacitor 95 is charged and keeps the voltage Vgs thereon. The voltage Vgs succeeds the data signal DS to light the OLED 96 by generating a current through the transistor 94 when the scan signal SS turns off the transistors 91 and 92 and turns on the transistor 93 to terminate transmission of the data signal DS at the end of the scan period. This circuit differs from the conventional circuit in that the transistor 97 is connected to the drain of the transistor 94. The gate of the transistors 97 receives a bias voltage $V_{bias}$ so that the transistors 94 and 97 operate in the saturation region.

Figure 10:
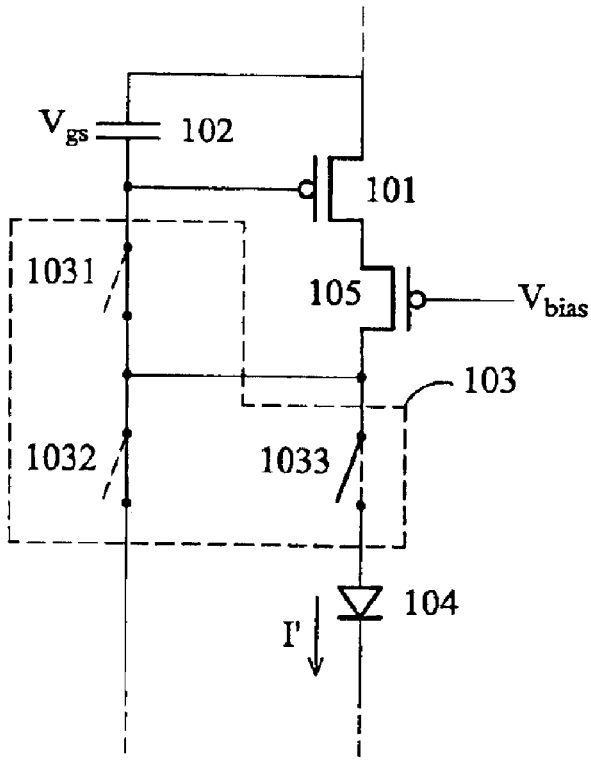
FIG. 10 is a diagram showing an equivalent circuit of the current-driven pixel circuits according to the embodiments of the invention.

FIG. 10 is a diagram showing an equivalent circuit of the current-driven pixel circuits according to the previous embodiments of the invention. It comprises transistors 101 and 105, a capacitor 102, a current switch 103 and an LED 104. The current switch 103 comprises three switches 1031~1033, and a data line connected to a current source (not shown). The switches 1031~1033 are controlled by the scan signal SS. The current source connected with the data line provides currents driving the LED 104. The gate of the transistor 105 receives a bias voltage $V_{bias}$ so that the transistors 101 and 105 operate in the saturation region.

At the beginning of the scan period, the switches 1031 and 1032 are closed and the switch 1033 is opened. If this pixel is lit in the current frame, the current I of the data signal DS flows through the transistors 101 and 105, and charging the capacitor 102 to keep the voltage Vgs thereon. When the scan signal opens the switches 1031 and 1032 and closes the switch 1033, the voltage Vgs succeeds the data signal DS to light the LED 104 by generating a current I' through the transistor 101.

Figure 1:
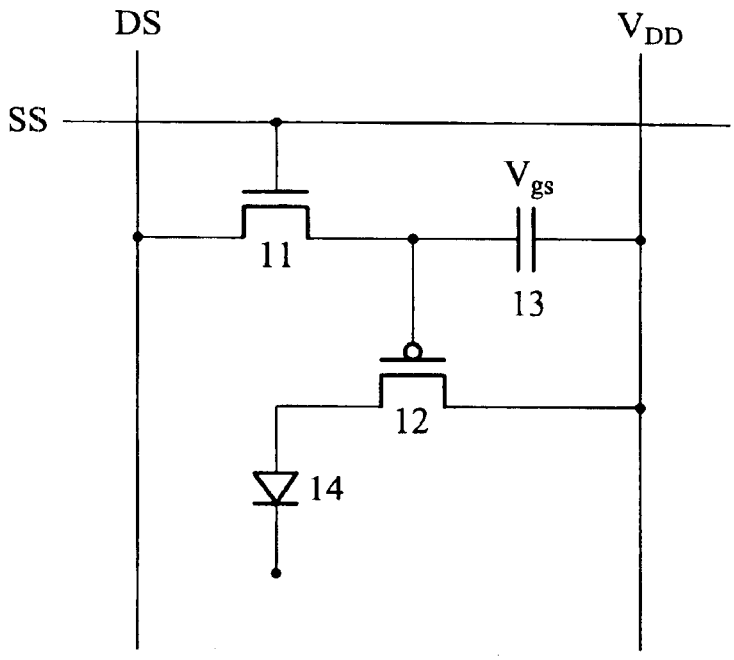
FIG. 1 ( PRIOR ART )
FIG. 1 is a diagram showing one voltage-driven pixel circuit in an active matrix LED display.
Figure 2:
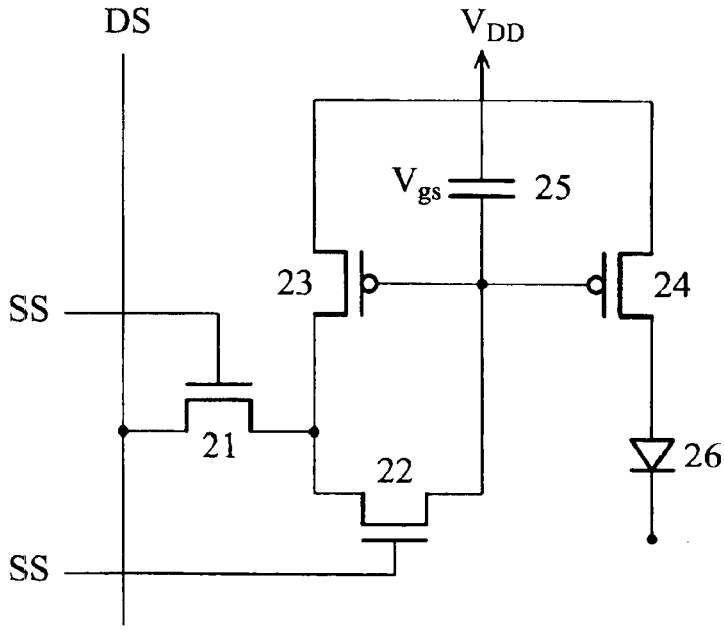
FIG. 2 ( PRIOR ART )
FIGS. 2, 3A, 3B, 4A and 4B are diagrams showing different current-driven pixel circuits in an active matrix LED display.
Figure 3A:
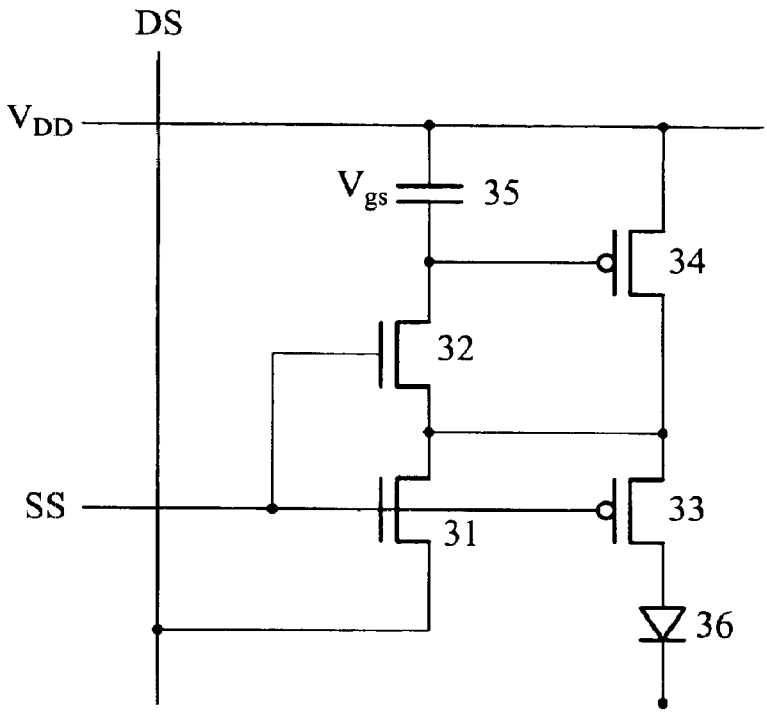
FIG. 3A ( PRIOR ART )
Figure 3B:
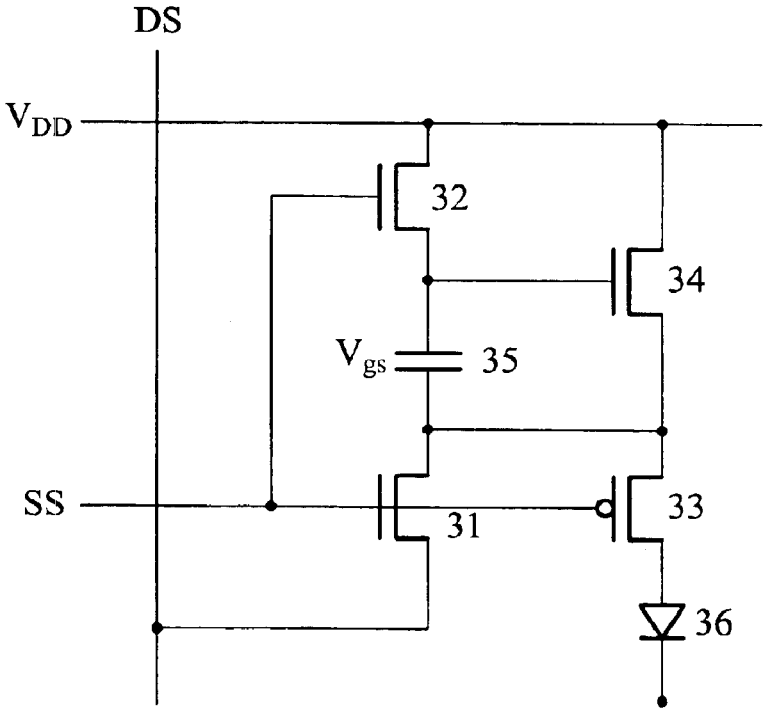
FIG. 3B ( PRIOR ART )
Figure 4A:
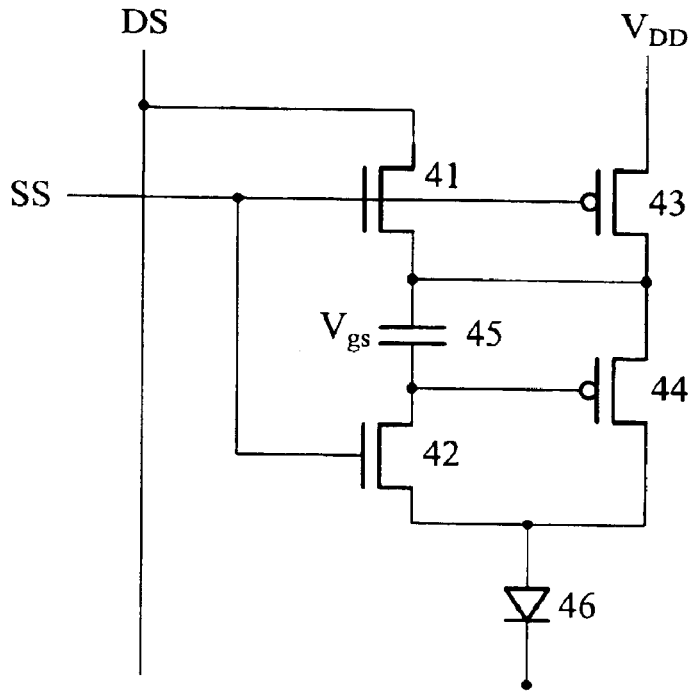
FIG. 4A ( PRIOR ART )
Figure 4B:
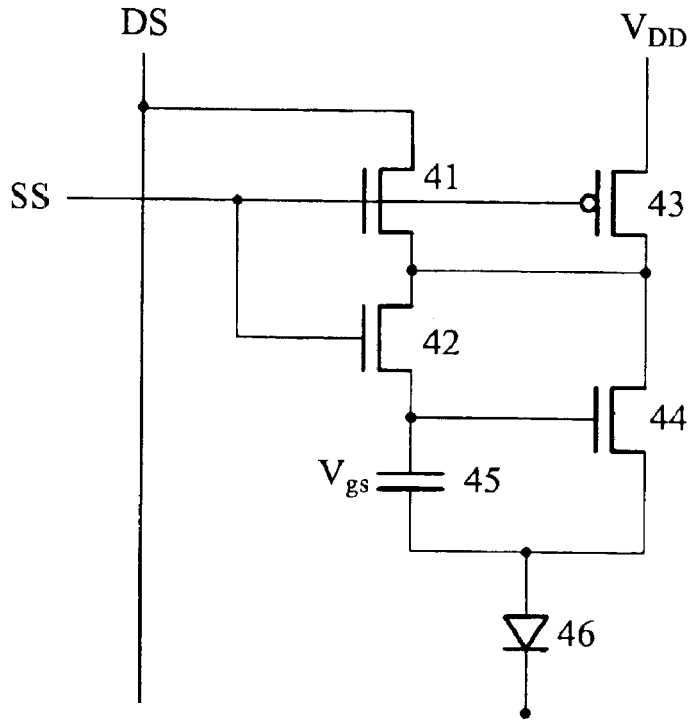
FIG. 4B ( PRIOR ART )
Figure 5:
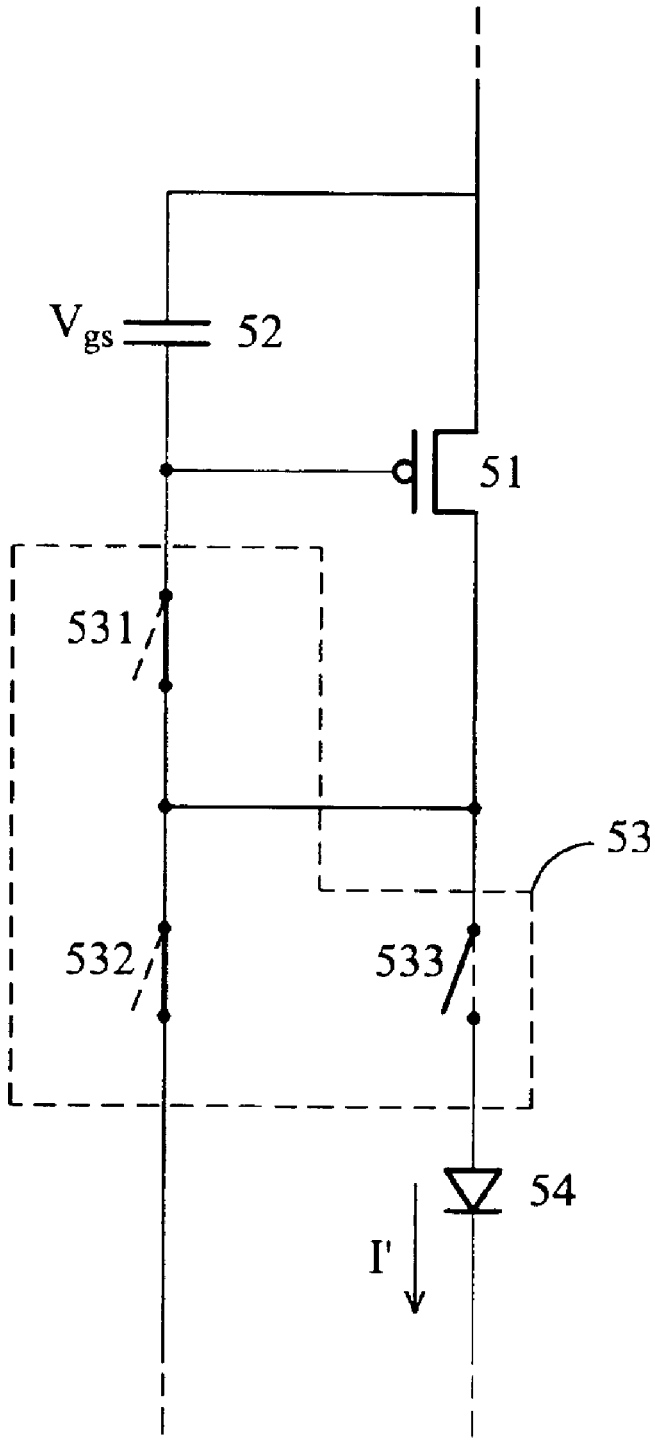
FIG. 5 ( PRIOR ART )
FIG. 5 is a diagram showing an equivalent circuit of the current-driven pixel circuits.
Figure 6:
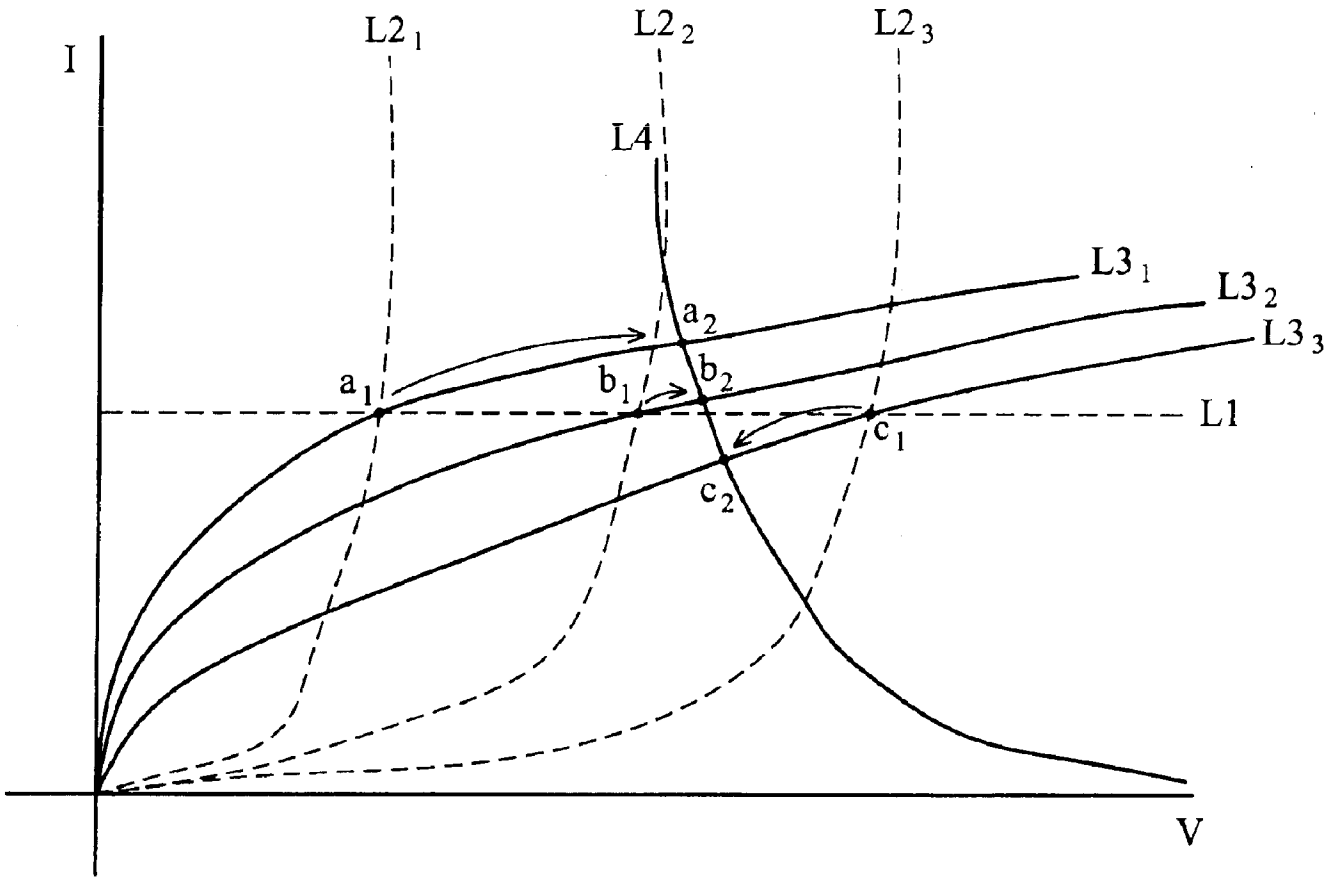
FIG. 6 ( PRIOR ART )
FIG. 6 is a diagram showing I-V characteristic curves of the transistors, data signal current source and LED.

By comparison of the equivalent circuits in FIGS. 5 and 10, it is found that, in the invention, the transistor 101 is additionally cascaded to the transistor 101 and a bias voltage is applied to its gate so that the two transistors operate in the saturation region. The transistor 105 depresses the variation of the drain-to-source voltage of the transistor 101, which diminishes the current shift due to the channel length modulation. The I-V characteristic curves of the transistors 101 and 105 get closer to each other. Thus, it is possible to achieve a display panel with uniform illumination even using transistors with different threshold voltages.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. An active matrix LED pixel driving circuit comprising:

a capacitor;

a light emitting diode;

a first and second transistor, wherein the capacitor is connected between a gate and source of the first transistor, and the second transistor has a source connected to a drain of the first transistor and a gate connected to receive a first voltage by which the first and second transistor operate in a saturation region; and a current switch controlled by a scan signal, wherein a first current corresponding to a data signal flows through the first and second transistor to generate a second voltage stored on the capacitor when the current switch is closed, and a second current through the first and second transistor is generated by the second voltage stored on the capacitor to turn on the light emitting diode when the current switch is opened.

2. The circuit as claimed in claim 1, wherein the current switch comprises:

a first switch controlled by the scan signal having a first end connected to receive the data signal;

a second switch controlled by the scan signal, and connected between a second end of the first switch and the gate of the first transistor; and a third transistor having a gate connected to the gate of the first transistor, a source connected to the source of the first transistor and a drain connected to the second end of the first switch;

wherein the first and third transistor act as a current mirror to generate the first current through the first and second transistor when the first and second switch is closed.

3. The circuit as claimed in claim 1, wherein the current switch comprises:

a first switch controlled by the scan signal having a first end connected to receive the data signal and a second end connected to the drain of the second transistor;

a second switch controlled by the scan signal, and connected between the second end of the first switch and the gate of the first transistor; and a third switch controlled by the scan signal, and connected between the light emitting diode and the drain of the second transistor;

wherein the first current is generated when the first and second switch is closed and the third switch is opened.

4. The circuit as claimed in claim 1, the current switch comprising:

a first switch controlled by the scan signal having a first end connected to receive the data signal and a second end connected to the drain of the second transistor;

a second switch controlled by the scan signal, and connected between the drain of the second transistor and the gate of the first transistor; and a third switch controlled by the scan signal having a first end connected to receive a third voltage and a second end connected to the drain of the second transistor;

wherein the first current is generated when the first and second switch is closed and the third switch is opened.

* * * * *